United States Patent [19]

Apholt

[11] Patent Number: 4,798,144

[45] Date of Patent: Jan. 17, 1989

[54] HOLLOW CHARGE SHELL CONSTRUCTED AS DRILL AMMUNITION

[75] Inventor: Horst Apholt, Hagen, Fed. Rep. of Germany

[73] Assignee: Hoesch Aktiengesellschaft, Dortmund, Fed. Rep. of Germany

[21] Appl. No.: 904,031

[22] Filed: Sep. 5, 1986

[30] Foreign Application Priority Data

Sep. 11, 1985 [DE] Fed. Rep. of Germany ... 353224112

[51] Int. Cl.[4] ..... F42B 13/20; F42B 13/22

[52] U.S. Cl. ..... 102/445; 102/498; 102/517; 102/529

[58] Field of Search ..... 102/444, 445, 498, 529, 102/395, 476, 501, 372, 374, 517

[56] References Cited

U.S. PATENT DOCUMENTS

| | | | |
|---|---|---|---|
| 1,825,517 | 9/1931 | Gardner . | |
| 3,019,733 | 2/1962 | Braid . | |
| 3,170,405 | 2/1965 | Jungermann et al.. | 102/529 |
| 3,416,449 | 12/1968 | Brothers | 102/476 |
| 3,463,047 | 8/1969 | Germershausen | 102/529 |
| 4,211,168 | 7/1980 | Haep | 102/444 |
| 4,428,294 | 1/1984 | Falkowski . | |
| 4,549,487 | 10/1985 | Jensen | 102/529 |

FOREIGN PATENT DOCUMENTS

| | | | |
|---|---|---|---|
| 1043545 | 11/1953 | France . | |
| 2154359 | 5/1973 | France . | |
| 2407453 | 5/1979 | France . | |
| 2536683 | 6/1984 | France . | |
| 646776 | 10/1962 | Italy | 102/445 |
| 2115118 | 9/1983 | United Kingdom | 102/529 |

*Primary Examiner*—Harold J. Tudor

*Attorney, Agent, or Firm*—Thomas S. Baker, Jr.

[57] ABSTRACT

A wing-stabilized hollow charge shell constructed as dummy ammunition and having a tail unit (13) of the same caliber comprises a front explosive chamber (1) and a rear explosive chamber (2) and at the end face of the shell case is provided with a detonator rod (4). The entire shell case, including the detonator rod (4), is formed by parts (3, 5, 7) consisting of the same or similar material which are undetachably connected together.

16 Claims, 3 Drawing Sheets

HOLLOW CHARGE SHELL CONSTRUCTED AS DRILL AMMUNITION

The invention relates to a wing-stabilized hollow charge shell which is constructed as drill ammunition and has a tail unit of the same caliber, comprising a front and a rear explosive chamber and being provided at the end face of the shell case with a detonator rod.

Hollow charge shells achieve their armour-piercing action with the aid of the so-called hollow charge effect. This effect is due essentially to the fact that due to the detonation of the explosive the insert elements striking together in the centre of the charge form a metal beam which is referred to as spike and which emerges with speeds up to $10^5$ m/s from the hollow charge space and due to this high speed pierces even thick armourings. The detonator bar provided at the end face of the shell case initiates the firing whilst maintaining the spacing necessary for the hollow charge development—the effect of a hollow charge shell depends on the distance of the hollow charge from the armouring at the instant of the detonation of the explosive.

Wing-stabilized hollow charge shells are provided at their rear portion with a tail unit which due to aerodynamic flow produces air forces and thus countermoments as soon as the shell is deflected out of its normal flight attitude by disturbing influences. The tail unit generally consists of aluminium.

Dummy ammunition is used for weapons drill, i.e. to practice charging, taking aim and hitting the target. This requires that the ammunition has exactly the same ballistics and thus the same form, the same weight and the same centre of gravity as live ammunition. Dummy ammunition is also used for function and approval tests of weapons.

Hollow charge shells constructed as drill ammunition have the same shell case as the live ammunition. However, an inert mass of the same density is pressed or cast into the shell case instead of the explosive charge.

In the known hollow charge shells the detonator rod or bar and the portion of the shell case forming the rear explosive chamber is in aluminium whereas the portion of the shell case forming the front explosive chamber consists of steel The individual parts of the shell case, as in live ammunition, are screwed together and accordingly must be exactly machined. The production of the known dummy ammunition is very involved and thus results in very high costs.

The invention is based on the problem of further developing the hollow charge shell of the type mentioned at the beginning constructed as dummy ammunition in such a manner that it is simple and cheap to make.

The solution of the problem set resides in that the entire shell case, including the detonator rod, is formed by parts which consist of the same material and which are undetachably connected together. For example, all the parts of the shell case can consist of steel.

With the dummy ammunition according to the invention on the one hand the individual parts of the shell case need not be provided with a thread, thus making the production thereof substantially simpler and cheaper, and on the other hand between the individual parts of the shell case no contact corrosion can occur.

In further development of the invention the part of the shell case forming the rear explosive chamber and the front closure plate of the shell case comprising the end face and the detonator rod as forged parts and connected together by a tube forming the front explosive chamber.

Forged parts are simple and cheap to make; tubes are cheap mass-produced articles. If the forged parts are made by drop forging the interior space of the parts already has its final form so that no finishing work is required In further development of the invention the front closure plate with the detonator rod and the front explosive chamber or the front explosive chamber and the rear explosive chamber are formed as integral forging so that the shell case consists of only a few individual parts and thus has only a few joints. The production of the parts can be by extrusion or stretch pressing.

Advantageously, the individual parts of the shell case are connected together by friction welding. It should be observed that the individual parts must have a certain overdimensioning at the connecting points and that the tube forming the front explosive chamber must be correspondingly longer than in its final state. It is not necessary to finish work the inner friction weld seams.

In a further development of the invention between the front and rear explosive chamber a protection disc is disposed. This protection disc prevents the shell case being compressed by the high firing pressure of about 5000 bar so that the shell case requires only a small wall thickness.

In a preferred embodiment of the invention the front closure plate and the detonator bar are provided with a bore. This bore serves to provide the shell with a small explosive charge and an impact detonator. This achieves on the one hand that the impact point is well marked whilst on the other hand an at least partial breaking down of the shell takes place, preventing uncontrollable ricochets.

The drawings show examples of three embodiments of the invention in side elevation, partially in section, illustrating the right half of a shell case in the unfinished state and the left half in the finished state, comprising a seal and a securing ring as well as a tail unit.

Figure 1:
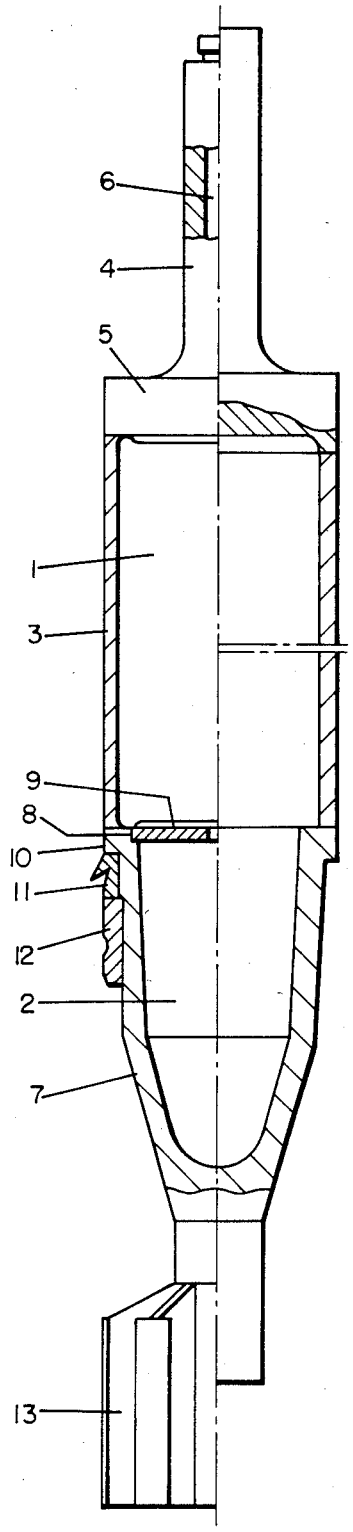
FIG. 1 shows a hollow charge shell according to the subject invention in which the rear explosive chamber and the front closure plate including the detonator are formed as forged parts and are connected together by a tube forming a front explosive chamber.
Figure 1A:
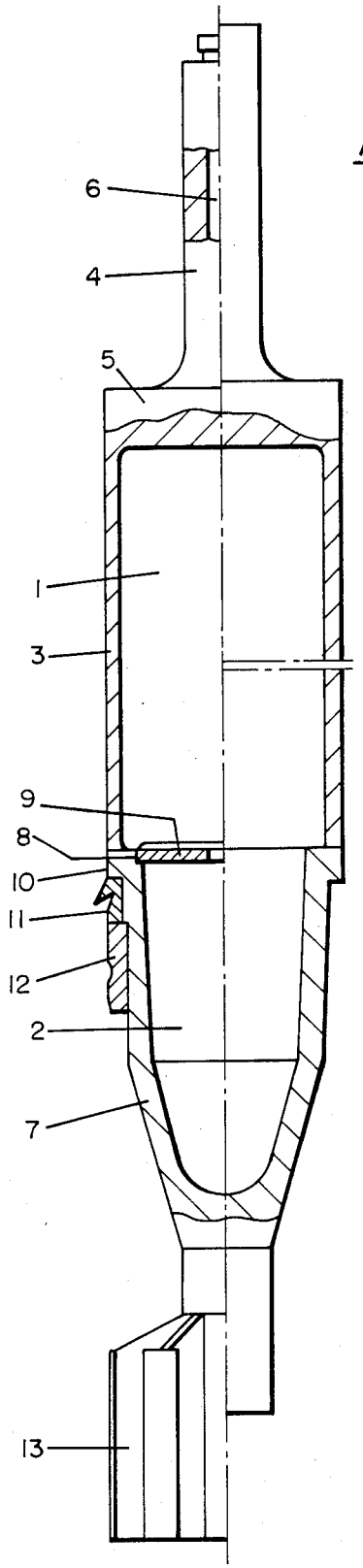
FIG. 1A illustrates a second embodiment of the invention in which the front closure plate including the detonator rod and the front explosive chamber are formed as an integral forged part.
Figure 1B:
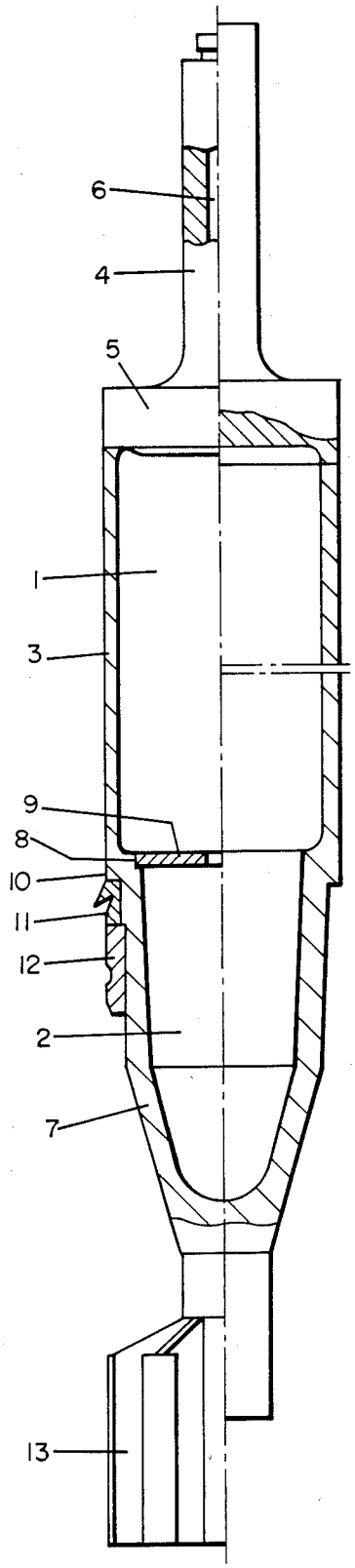
FIG. 1B illustrates a third embodiment of the invention in which the front explosive chamber and the rear explosive chamber are formed as an integral forged part.

The shell case illustrated comprises a front explosive chamber 1 and a rear explosive chamber 2. The front explosive chamber 1 is formed by a tube 3 and sealed by means of a closure plate 5 provided with a detonator rod 4. The closure plate 5 and the detonator rod 4 are provided with a bore 6. The portion 7 forming the rear explosive chamber 2 is provided at its end facing the front explosive chamber 1 with a turned down portion 8 into which a protective disc 9 is inserted. The protective disc 9 is connected in force-locking manner by the heat action occurring in friction welding and located in form-locking manner by the projecting friction weld seam. The rear explosive chamber 2 comprises at its end facing the front explosive chamber 1 a flange-like extension 10 against which an annular seal 11 bears. The seal 11 is held by a shrunk-on or pressed-on securing ring 12. At its end portion the part of the shell case forming the rear explosive chamber is provided with a tail unit 13.

The shell illustrated in the drawings is made in that after the turning of the end faces of the tube 3 and the connecting points of the front closure plate 5 with the detonator rod 4 and of the part 7 forming the rear explosive chamber the closure plate 5 and the detonator rod 4 are provided with the bore 6 and the part 7 with the turned-down portion 8. Thereafter the protective disc 9 is inserted into the turned-down portion 8. Then, the closure plate 5, the tube 3 and the part 7 are joined together by friction welding. Subsequently the shell case is given its final outer form by turning down, previously attached centering recesses ensuring that the inner and outer form extend centrally to the centre axis of the shell case so that no wall thickness differences can occur over the periphery. Then, the seal 11 and the securing ring 12 are attached Finally, the tail unit 13 is attached to the rear end of the part 7.

I claim:

1. A wing-stabilized hollow charge shell which is constructed as drill ammunition and has a tail unit of the same caliber comprising a shell case having a front and a rear explosive chamber, and an end face adjacent the front explosive chamber and being provided at the end face of the shell case with a detonator rod, characterized in that the entire shell case, including the detonator rod (4), is formed by parts which consist of the same metallic material and which are undetachable and fixedly connected together by friction welding and at least one of said front explosive chamber, rear explosive chamber and said detonator rod is produced by forging.

2. A hollow charge shell according to claim 1, characterized in that the part of the shell case forming the rear explosive chamber (2) and a front closure plate (5) comprising the end face and the detonator rod are formed as forged parts and wherein said rear explosive chamber and said front closure plate and said detonator rod are connected together by a tube (3) forming the front explosive chamber (1).

3. A hollow charge shell according to claim 1, characterized in that a front closure plate (5) comprising the end face, the detonator rod (4) and the front explosive chamber (1) are formed as an integrally forged part.

4. A hollow charge shell according to claim 1, characterized in that the front explosive chamber (1) and the rear explosive chamber (2) are formed as an integrally forged part.

5. Hollow charge shell according to claim 1, characterized in that between the front explosive chamber (1) and the rear explosive chamber (2) a protective disc (9) is provided.

6. Hollow charge shell according to claim 2, characterized in that between the front explosive chamber (1) and the rear explosive chamber (2) a protective disc (9) is provided.

7. Hollow charge shell according to claim 3, characterized in that between the front explosive chamber (1) and the rear explosive chamber (2) a protective disc (9) is provided.

8. Hollow charge shell according to claim 4, characterized in that between the front explosive chamber (1) and the rear explosive chamber (2) a protective disc (9) is provided.

9. Hollow charge shell according to claim 1, characterized in that the front closure plate (5) and the detonator rod (4) are provided with a bore (6).

10. Hollow charge shell according to claim 2, characterized in that the front closure plate (5) and the detonator rod (4) are provided with a bore (6).

11. Hollow charge shell according to claim 3, characterized in that the front closure plate (5) and the detonator rod (4) are provided with a bore (6).

12. Hollow charge shell according to claim 4, characterized in that the front closure plate (5) and the detonator rod (4) are provided with a bore (6).

13. Hollow charge shell according to claim 5, characterized in that the front closure plate (5) and the detonator rod (4) are provided with a bore (6).

14. Hollow charge shell according to claim 6, characterized in that the front closure plate (5) and the detonator rod (4) are provided with a bore (6).

15. Hollow charge shell according to claim 7, characterized in that the front closure plate (5) and the detonator rod (4) are provided with a bore (6).

16. Hollow charge shell according to claim 8, characterized in that the front closure plate (5) and the detonator rod (4) are provided with a bore (6).-

* * * * *